US007076895B2

(12) United States Patent
Haugen et al.

(10) Patent No.: US 7,076,895 B2
(45) Date of Patent: Jul. 18, 2006

(54) APPARATUS AND METHOD FOR SUCTION AND DISCHARGE OF MATERIAL

(75) Inventors: Karl T. Haugen, Blentarp (SE); Gert Lovgren, Bjarred (SE); Jan Billberg, Genarp (SE); Gisle Hauk, Skien (NO)

(73) Assignee: Disab Vacuum Technology AB, Eslov (SE)

( * ) Notice: Subject to any disclaimer, the term of this patent is extended or adjusted under 35 U.S.C. 154(b) by 0 days.

(21) Appl. No.: 10/486,399

(22) PCT Filed: Sep. 24, 2002

(86) PCT No.: PCT/SE02/01727

§ 371 (c)(1),
(2), (4) Date: Feb. 10, 2004

(87) PCT Pub. No.: WO03/027402

PCT Pub. Date: Apr. 3, 2003

(65) Prior Publication Data

US 2004/0194354 A1 Oct. 7, 2004

Related U.S. Application Data

(60) Provisional application No. 60/324,044, filed on Sep. 24, 2001.

(30) Foreign Application Priority Data

Sep. 24, 2001 (SE) ..... 0103174

(51) Int. Cl.
*E02F 5/22* (2006.01)

(52) U.S. Cl. ..... 37/104; 37/105; 104/2

(58) Field of Classification Search ..... 37/104, 37/105, 106, 107; 171/16; 104/2–7.3
See application file for complete search history.

(56) References Cited

U.S. PATENT DOCUMENTS

| | | | | |
|---|---|---|---|---|
| 4,203,493 | A * | 5/1980 | Miller | 171/16 |
| 4,268,175 | A * | 5/1981 | Norlie et al. | 366/19 |
| 4,955,302 | A * | 9/1990 | Theurer et al. | 104/7.2 |
| 5,099,766 | A * | 3/1992 | Whitaker, Jr. | 104/2 |
| 5,425,188 | A | 6/1995 | Rinker | |
| 5,452,528 | A | 9/1995 | Theurer et al. | |
| 5,709,270 | A | 1/1998 | Theurer et al. | |
| 6,155,506 | A * | 12/2000 | Loppoli | 241/186.3 |

FOREIGN PATENT DOCUMENTS

| | | |
|---|---|---|
| DE | 3331315 | 3/1985 |
| DE | 4341240 | 6/1994 |
| DE | 29923449 | 10/2000 |

* cited by examiner

*Primary Examiner*—Thomas A Beach
(74) *Attorney, Agent, or Firm*—Browdy and Neimark, PLLC

(57) ABSTRACT

An apparatus for suction and discharge of material comprises a container (9) with a suction opening (19) for letting in a sucked-up air/material mixture and a discharge opening (14) for discharging material. The container (9) is rotatable and has inner conveying means (18) which upon rotation of the container (9) are adapted to convey the material to the discharge opening (14).

24 Claims, 3 Drawing Sheets

APPARATUS AND METHOD FOR SUCTION AND DISCHARGE OF MATERIAL

CROSS-REFERENCE TO RELATED APPLICATIONS

This application claims the benefit of U.S. patent application Ser. No. 60/324,044 filed Sep. 24, 2001 and Swedish patent application No. 0103174-9 filed Sep. 24, 2001, all of which are incorporated herein by reference.

FIELD OF THE INVENTION

The present invention relates to an apparatus and a method for suction and discharge of material.

BACKGROUND ART

Apparatus for suction and discharge of material as mentioned above are used, for instance, when making excavations in areas where electricity cables, telecommunication cables and the like are buried in the ground, and where an ordinary excavator may cause damage by breaking such cables by mistake. The material sucked up consists of stones, macadam, gravel, sand, earth etc. Such apparatus can also be used to suck up material in liquid form, such as mud and wet clay. One field of application is to suck up ballast adjacent to the rail when reconditioning railroad lines.

In a prior-art procedure, the ballast is sucked through a hose into a vacuum container which is placed on a rail vehicle. When the container is full, doors in the sides of the container are opened, and the ballast is discharged along the vehicle sides. There is usually some kind of guide plates arranged at the side of the vehicle below the doors in the container sides to direct the discharge in the desired direction somewhat obliquely away from the container. This prior-art apparatus cannot be used in cases where the sucked-up material is to be discharged behind the vehicle, for example to be able to convey it onto a collecting vessel.

U.S. Pat. No. 5,709,270 discloses another apparatus arranged on a rail vehicle for drawing in ballast by suction, for example, when renovating railroad lines. The ballast is drawn up by suction to a vacuum container which, when being full, is opened via a door in the bottom of the container. The ballast is discharged onto a conveyor belt running under the vehicle and discharging the ballast at the rear end of the vehicle, optionally onto another conveyor belt and then onto another container.

A difficulty in this prior-art apparatus is that the conveyor belt for conveying material to the rear end of the vehicle is arranged under the container and the other parts mounted on the vehicle, such as drive means etc, which makes the space for the conveyor belt very limited in the vertical direction. This makes it difficult to reach the conveyor belt for maintenance and repair. Moreover, the belt may easily come to a standstill when material is pinched between the conveyor belt and the lower parts of the superposed devices.

In all these prior-art apparatus, problems arise when discharging wet material since this sticks to the inner walls of the container, thus making it difficult to entirely empty the container. Low temperatures will also cause inconvenience when discharging, for instance, blue clay. The same problem arises when discharging, for instance, macadam according to the prior-art technique, when the material is stopped at the opening of the container and is retained above the opening owing to so-called bridging in the material according to the principle used to build stone bridges in former times.

This problem has been solved by arranging vibrators to vibrate the container so as to make the material come loose from the walls. However, this easily results in all the material falling out of the container in an uncontrolled manner, which is unfavourable.

The fact that the discharging occurs in an uncontrolled manner, both with and without the use of vibrators, means that it is not possible to control the speed of the material flowing out of the container once the door in the bottom of the container or the doors in the sides of the container are open. Nor is it possible to interrupt a discharging process, for instance in the case of a near-accident.

The uncontrolled discharging may also give rise to great strain on the conveyor belt receiving the material flowing out. In many cases a ketchup effect occurs in discharging, which causes a momentarily very high load on the conveyor belt or other devices receiving the discharged material. Problems with build-up of dust may also arise when dry material is discharged too quickly from the container. Dust build-up may cause negative environmental and health effects.

In another known procedure, the container is instead tilted for discharging and the material is discharged behind the vehicle. Also in this case, the problems mentioned above in connection with quick emptying may arise. When tilting the container, problems will also arise when driving through tunnels having a limited height, where discharge can be made difficult or prevented by there not being sufficient space in the vertical direction for tilting of the container.

SUMMARY OF THE INVENTION

An object of the present invention is to obviate the above problems by providing a device for suction and discharge of material, where the discharging operation takes place in a controlled manner, said device being further suited for use in tunnels and for use both for solid and liquid materials.

The invention gives the advantage that discharge takes place in a controllable manner since the discharge speed can easily be controlled by regulating the speed of rotation of the container. Moreover, the discharge operation may be interrupted when necessary and may then be easily started again. Furthermore, both solid and liquid materials, as well as mixtures thereof, can be easily and safely discharged completely from the container. Further no tilting of the container is necessary in the discharge operation.

The conveying means are preferably at least partly helical. This gives the advantage of easily performing efficient transport of the material to the discharge opening. It also facilitates the manufacture of the apparatus.

The suction opening is connected to a suction duct preferably via a first connecting means. This gives the advantage of facilitating the supply of the material/air mixture to the container.

According to an embodiment of the invention, the first connecting means may allow disconnection of the suction duct from the container. This gives the advantage that the entire container can easily be rotated without the suction duct being affected.

The container can have an exhaust opening for letting out air. This is advantageous since it easily allows the generation of a negative pressure in the container, which ensures efficient drawing-in of material and air by suction.

The exhaust opening can via a second connecting means be connected to an exhaust duct which communicates with an extractor for air. This gives the advantage of easily generating a negative pressure in the container.

The extractor preferably comprises at least one vacuum pump. This gives the advantage of ensuring efficient drawing-in of material by suction to the container through the suction opening and also efficient extraction of air from the container through the exhaust opening.

According to an embodiment of the invention, at least one filter is arranged between the exhaust duct and the extractor, which gives the advantage of efficiently filtering away any entrained particles from the container and separating these before they reach the extractor so as not to interfere with the function of the extractor.

Preferably the extractor comprises a filter, which gives the advantage of ensuring that only a minimum amount of dust particles can be entrained to those parts, for instance pumps, in the extractor, whose function can be interfered with.

The second connecting means can, according to an embodiment of the invention, allow disconnection of the exhaust duct from the container. This gives the advantage that the entire container can easily be rotated without affecting the exhaust duct.

The discharge opening is preferably sealable, which gives the advantage of allowing the generation of a negative pressure in the container, which results in the above-mentioned advantages. It is particularly advantageous if the discharge opening is hermetically sealable.

The suction and exhaust openings are preferably sealable, which gives the advantage that no material can flow or fall out of the container through the exhaust or suction openings in particular when the container is rotated during discharge. It is particularly preferred to combine this with embodiments involving disconnectible connecting means.

According to an embodiment of the invention, a conveyor belt is arranged in the vicinity of the discharge opening outside the container for conveying material discharged from the container. This gives the advantage of easily being able to convey material from the apparatus, for instance to a storage container.

According to a preferred embodiment of the invention, a longitudinal axis of the container is inclined relative to a horizontal plane, the discharge opening being arranged at the upper end of the container. This gives the advantage of minimising the amount of material that possibly falls or flows out of the container at the moment when the discharge opening is opened. A further advantage is that the arrangement of a possible conveyor belt in the vicinity of the discharge opening for removing material is facilitated. This is particularly advantageous in the cases where a plurality of conveyor belts are used.

The above advantages are achieved also by a method according to the invention, by use of an apparatus according to the invention, as well as by a vehicle according to the invention.

BRIEF DESCRIPTION OF THE DRAWINGS

The invention will now be described in more detail with reference to the accompanying schematic drawings which by way of example illustrate a currently preferred embodiment of the invention.

DESCRIPTION OF PREFERRED EMBODIMENTS

Figure 1:
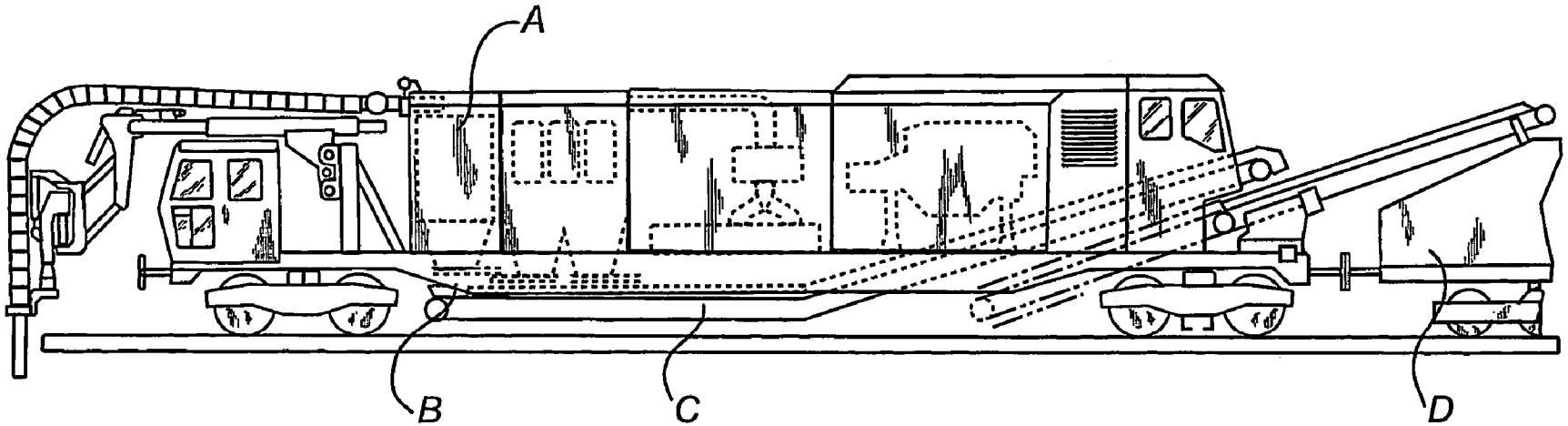
Fig. 1 Prior Art
FIG. 1 is a schematic side view of a prior-art apparatus for suction and discharge of material.

FIG. 1 shows an example of a prior-art apparatus A for suction and discharge of material when used on a rail vehicle B. A conveyor belt C is arranged along the rail vehicle B for conveying material to a collecting tank D arranged at the rear end of the rail vehicle B.

Figure 2:
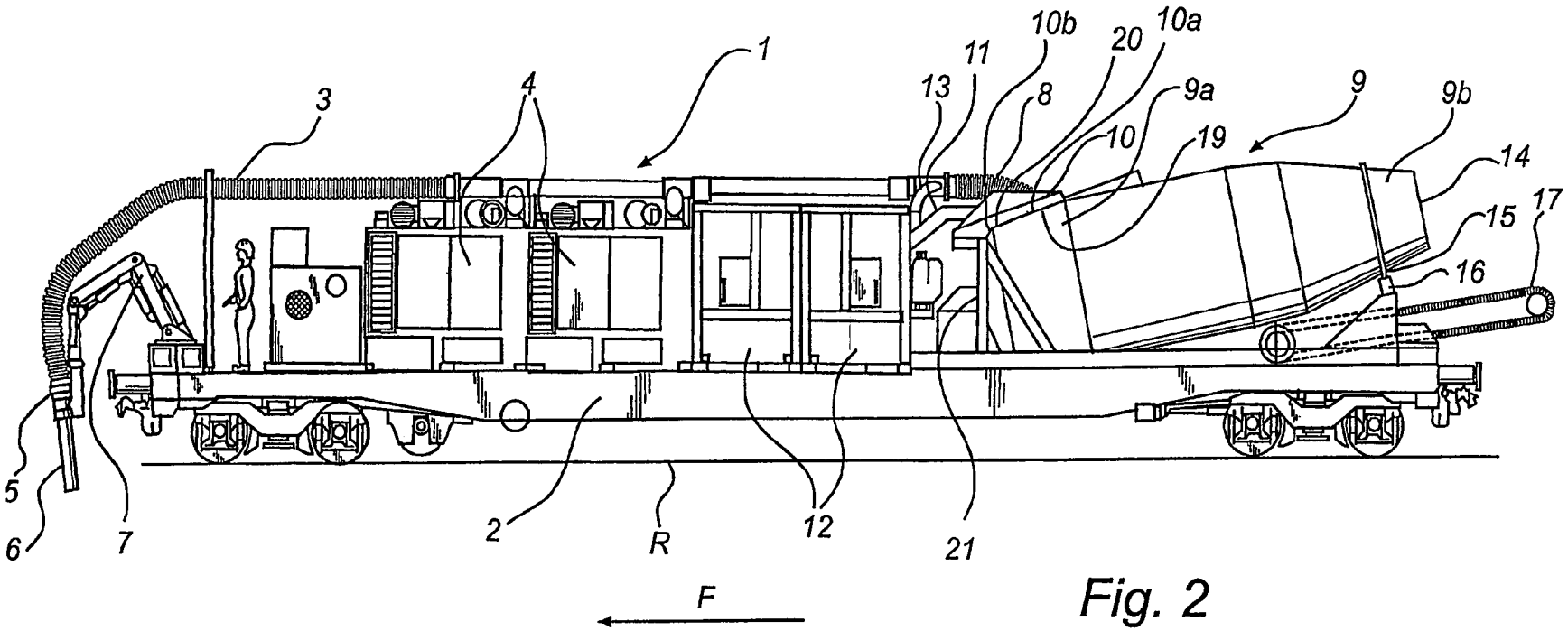
FIG. 2 is a similar view of a preferred embodiment of the inventive apparatus when used on a rail vehicle.
Figure 3:
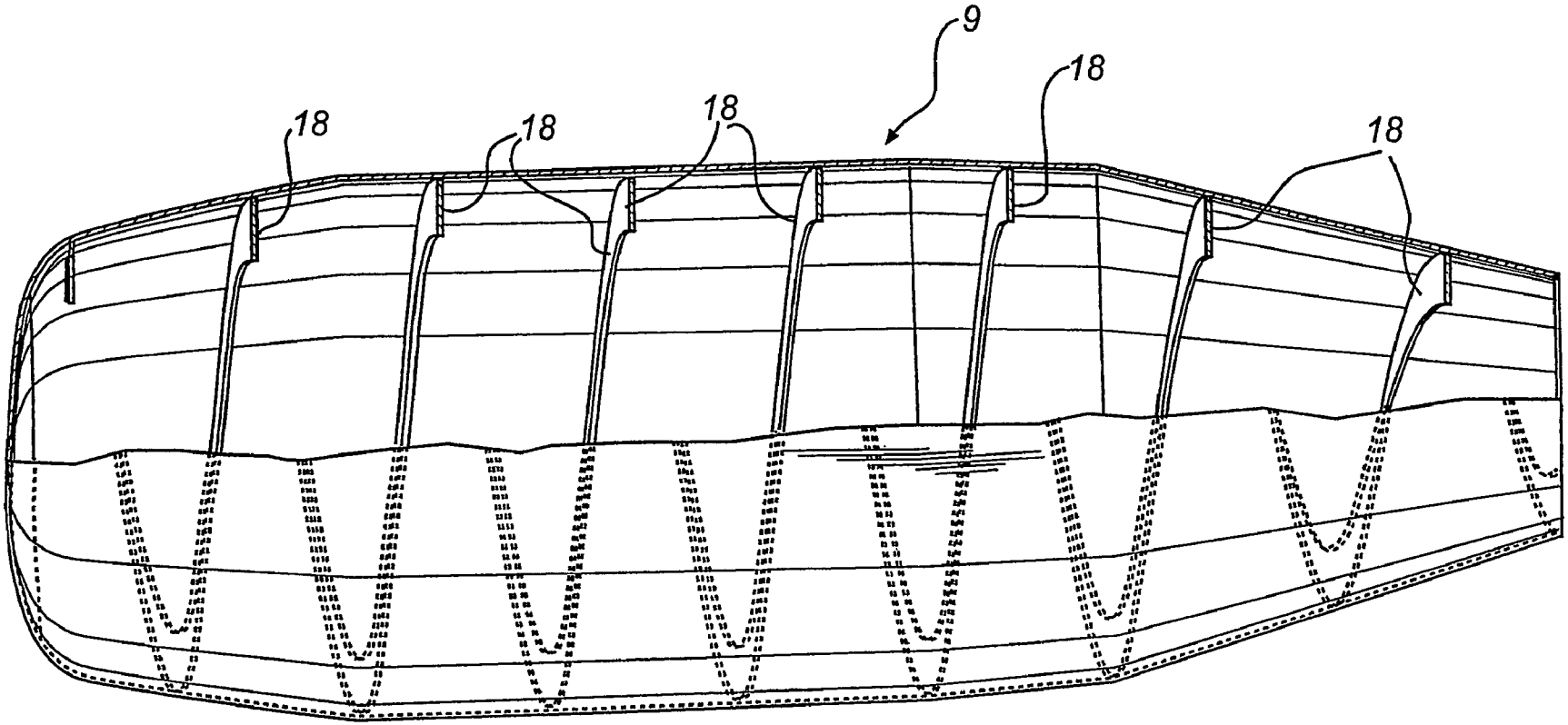
FIG. 3 is a sectional view of a container in the apparatus in FIG. 2.

With reference to FIGS. 2 and 3, an apparatus for suction and discharge according to the invention will now first be described. Then the suction and discharge function of the apparatus will be described.

FIG. 2 shows an apparatus 1 for suction and discharge which is used like in FIG. 1 in connection with a rail vehicle 2. The apparatus 1 comprises an elongate and flexible suction hose 3 communicating with two vacuum pumps 4 connected in parallel. The vacuum pumps 4 are, as shown in FIG. 2, arranged one behind the other on the rail vehicle 2. A first end 5 of the suction hose 3 is connected to a nozzle 6. The nozzle 6 is moved along the rail R at the front end of the rail vehicle 2, according to an imaginary direction of travel in the direction of arrow F, for drawing in material by suction. The nozzle 6 is controlled by an operator by means of an articulated control arm 7 arranged on the rail vehicle 2. The suction hose 3 is arranged along the longitudinal direction of the rail vehicle 2 and its second end 8 opens in a suction opening 19 in a cylindrical container 9. The connection between the second end 8 of the suction hose 3 and the container 9 takes place by means of a docking plate 10 detachable from the container 9.

The container 9 also has an exhaust opening 20 which is arranged in the vicinity of said suction opening 19. An exhaust hose 11 is, via the above docking plate 10, at its one end connected to the exhaust opening 20 of the container 9. The other end of the exhaust hose 11 communicates with two filters 12 which are connected in parallel and arranged one after the other on the rail vehicle 2 and communicating with the above-mentioned vacuum pumps 4. Moreover each vacuum pump 4 is provided with an additional filter (not shown), a so-called safety filter. A duct 13 connects the filters 12 to the suction hose 3.

The cylindrical container 9 is arranged at the rear end of the rail vehicle 2 and has a longitudinal direction corresponding to that of the rail vehicle 2. The container 9 has three openings, the suction and the exhaust openings 19, 20 which are mentioned above and which at a front end 9*a* of the container 9 via a docking plate 10 connect the container 9 with the suction and exhaust hoses 3, 11, and a sealable discharge opening 14 in the tapering rear part 9*b* of the container 9. The container 9 is inclined so that its longitudinal axis is inclined to an imaginary horizontal plane. The rear end 9*b* of the container is thus arranged at a higher level than its front end 9*a*. A flange 15 is arranged along the circumference of the rear portion 9*b* of the container. The flange 15 is in contact with rolls 16 on the rail vehicle 2. The container 9 is thus at its rear end 9*b* in contact with the rail vehicle 2 via said rolls 16 and at its front end 9*a* in contact via a drive shaft 21. The drive shaft 21 allows rotation of the container 9.

The rail vehicle 2 has at its rear end, below the discharge opening 14 of the container 9, a conveyor belt 17.

The function of the apparatus 1 which has been described above can be divided into two phases, a suction phase and a discharge phase. In the suction phase, material is drawn in by suction from the area around the rail via the nozzle 6 to the suction hose 3. The suction function in the suction hose 3 is generated by the vacuum pumps 4 via the exhaust hose 11 drawing in air from the container 9. A negative pressure is therefore generated in the container 9 and an influx of material and air can therefore take place to the container 9 through the suction hose 3. The material falls down in the container and is separated from the air which is extracted from the container 9 by the suction pumps 4. Then the air passes the two filters 12 to ensure that particles do not reach the vacuum pumps 4. Any particles that are collected in the filters 12 will, via the duct 13, between the filters 12 and the suction hose 3, be moved from the filters 12 to the suction hose 3 and then be discharged into the container 9. In order to further protect the vacuum pumps 4 from any particles, the air passes, before it reaches the vacuum pumps 4, safety filters which are arranged in connection with each vacuum pump 4.

The suction phase continues as long as is desirable or until the container 9 is filled to a predetermined level. The discharge opening 14 is, during the entire suction phase, hermetically sealed. Also the connection between the docking plate 10 and the container 9 is hermetically sealed. These hermetic seals are necessary to generate the negative pressure in the container 9 that is necessary for a suction function in the suction hose 3.

After the suction phase, the discharge phase takes place when the material collected in the container 9 is discharged onto the conveyor belt 17. The vacuum pumps 4 are then switched off and the docking plate 10 is disconnected from the container 9. The suction and exhaust openings 19, 20 of the container 9 are sealed by a door each or by a common door, and the discharge opening 14 is opened. Rotation of the container 9 takes place by means of a drive shaft 21 which is connected to the front end 9*a* of the container and arranged on the rail vehicle 2. During rotation of the container 9, the material is discharged via the discharge opening 14 onto the conveyor belt 17.

The discharge of the material from the container 9 takes place by means of conveying means such as vane-shaped conveyors or flanges 18 which are helically arranged on the inside of the container 9, as shown in FIG. 3. Thus the flanges 18 convey the material from the front end 9*a* of the container to the rear end 9*b* thereof and out of the discharge opening 14. The discharge speed of the material from the container 9 is determined by the speed of the drive shaft 21 in connection with the front end 9*a* of the container.

When the discharge phase is terminated, a new suction phase can be begun. The rotation of the container 9 is stopped, the doors covering the suction and exhaust openings 19, 20 are removed, the docking plate 10 with the suction and exhaust hoses 3, 11 is connected to the container 9 and the discharge opening 14 is sealed. Subsequently the vacuum pumps 4 can be started once more.

It will be appreciated that many modifications of the above-described embodiment of the invention are feasible within the scope of the invention, as defined in the appended claims.

For instance, the invention is not bound by the number of vacuum pumps or filters. Nor does the entire container 9 have to be rotatable. For instance, the container 9 may consist of two parts, the first end 9*a* of the container 9, which communicates with the suction and exhaust hoses 3, 11, being nonrotatable, while the rest of the container 9 is rotatable and is in rotational contact with the front end 9*a* of the container. During rotation of the container 9 in the discharge phase, the suction and exhaust hoses 3, 11 thus need not in this case be disconnected from the container 9 via the docking plate 10.

The apparatus may also be used in other applications, such as arranged on a truck, a caterpillar vehicle, a ship or the like, or when placed in a stationary manner, such as in factory premises.

The invention claimed is:

1. An apparatus for suction and discharge of material, comprising a container (9) with a suction opening (19) for letting in a sucked-up air/material mixture and a discharge opening (14) for discharging of material, characterized in that the container (9) is rotatable and has inner conveying means (18) which upon rotation of the container (9) are adapted to convey the material to the discharge opening (14);

wherein the container (9) has an exhaust opening (20) for letting out air.

2. The apparatus as claimed in claim 1, in which the conveying means (18) are at least partly helical.

3. The apparatus as claimed in claim 1, in which the suction opening (19) is connected to a suction duct (3) via a first connecting means (10*a*).

4. The apparatus as claimed in claim 3 in which the first connecting means (10*a*) allows disconnection of the suction duct (3) from the container (9).

5. The apparatus as claimed in claim 1, in which the exhaust opening (20) via a second connecting means (10*b*) is connected to an exhaust duct (11) communicating with an extractor (4) for air.

6. The apparatus as claimed in claim 5, in which the extractor (4) comprises at least one vacuum pump.

7. The apparatus as claimed in claim 5, in which at least one filter (12) is arranged between the exhaust duct (11) and the extractor (4).

8. The apparatus as claimed in claim 5, in which the extractor (4) comprises a filter.

9. The apparatus as claimed in claim 5, in which the second connecting means (10*b*) allows disconnection of the exhaust duct (11) from the container (9).

10. The apparatus as claimed in claim 1, in which the discharge opening (14) is sealable.

11. The apparatus as claimed in claim 10, in which the discharge opening (14) is hermetically sealable.

12. The apparatus as claimed in claim 1, in which the suction and exhaust openings (19, 20) are sealable.

13. The apparatus as claimed in claim 1, in which a conveyor belt (17) is arranged in the vicinity of the discharge opening (14) outside the container (9) for conveying material discharged from the container (9).

14. The apparatus as claimed in claim 1, in which a longitudinal axis of the container (9) is inclined relative to a horizontal plane, the discharge opening (14) being arranged at the upper end of the container (9).

15. A method for suction and discharge of material, characterized by the steps of connecting via a first connecting means a suction duct to a suction opening in a rotatable container, connecting via a second connecting means an exhaust duct to an exhaust opening in the container, the exhaust duct communicating with an extractor for air, drawing in material and air from the suction duct by suction through the suction opening into the container, drawing in air from the container by suction through the exhaust opening to the exhaust duct, material and air being separated, detecting a filling level in the container, disconnecting, when said level exceeds a predetermined threshold value, via said first and second connecting means the suction and exhaust ducts from the container, and opening a discharge opening in the container, and conveying, by rotation of the container, the material out of the discharge opening with the aid of at least partly helical conveying means arranged in the container.

16. The method as claimed in claim 15, in which the suction opening and the exhaust opening are sealed before the container is rotated.

17. The method as claimed in claim 15, in which the air drawn in by suction through the exhaust duct is made to pass a filter before it reaches the extractor.

18. The method as claimed in claim 15, in which the air is made to pass a filter in the extractor.

19. A method for using an apparatus as claimed in claim 1 when mounted on a vehicle, comprising drawing in material, by suction, from near said vehicle.

20. A method of using an apparatus according to claim 1, said apparatus being mounted on a rail vehicle, comprising drawing in material by suction from near said rail vehicle.

21. A vehicle characterized in that it comprises an apparatus as claimed in claim 1.

22. A vehicle as claimed in claim 21, in which the container (9) has its rotary axis oriented essentially in the travelling direction of the vehicle and in which the discharge opening is oriented essentially backward as regards the vehicle.

23. A vehicle characterized in that it comprises an apparatus as claimed in claim 2.

24. A vehicle as claimed in claim 23, in which the container (9) has its rotary axis oriented essentially in the travelling direction of the vehicle and in which the discharge opening is oriented essentially backward as regards the vehicle.

* * * * *